United States Patent [19]

Gamble

[11] 4,450,631

[45] * May 29, 1984

[54] HEATED CAN ROLLS OF HIGH THERMAL EFFICIENCY

[75] Inventor: James E. Gamble, Newark, Del.

[73] Assignee: Bunnell Plastics, Inc., Mickelton, N.J.

[ * ] Notice: The portion of the term of this patent subsequent to Sep. 14, 1999 has been disclaimed.

[21] Appl. No.: 417,842

[22] Filed: Sep. 14, 1982

Related U.S. Application Data

[63] Continuation of Ser. No. 942,942, Sep. 18, 1978, Pat. No. 4,348,819.

[51] Int. Cl.[3] ..... F26B 13/08

[52] U.S. Cl. ..... 34/110; 34/124; 165/89

[58] Field of Search ..... 34/110, 119, 124; 100/93 RP; 162/207, 375, 378, 379; 165/89, 146, 185; 219/10–49 A, 469; 432/10, 60, 253, 255.1; 29/110, 118, 119

[56] References Cited

U.S. PATENT DOCUMENTS

| | | | |
|---|---|---|---|
| 1,640,855 | 8/1927 | Shlick | 34/110 |
| 4,348,819 | 9/1982 | Gamble | 34/124 |

*Primary Examiner*—Larry I. Schwartz

*Attorney, Agent, or Firm*—Howson and Howson

[57] ABSTRACT

Disclosed is an improved heated can roll for paper-making machines having a high thermal efficiency. The improvement is in a means for insulating the ends of the internally heated can rolls to provide segmental heat insulating part spaced from the roll end or head to provide an air space adjacent to the head or roll ends, resulting in a large reduction in heat loss through natural convection, convection due to rotation, forced convection due to air draft, and radiation and resulting in a more uniform drying surface temperature.

10 Claims, 7 Drawing Figures

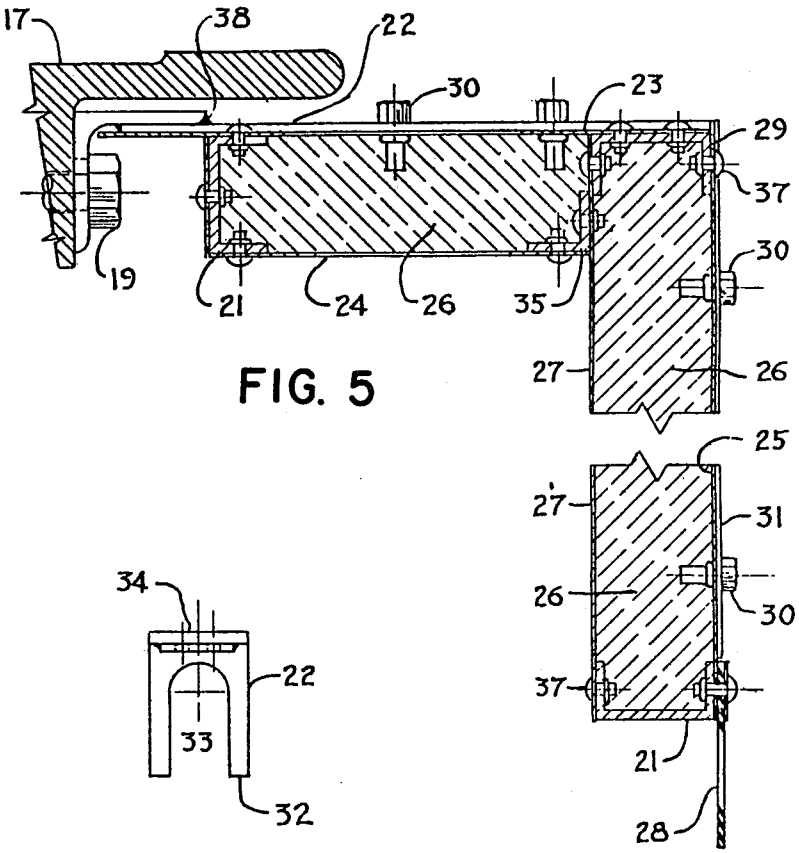
FIG. 5
FIG. 6
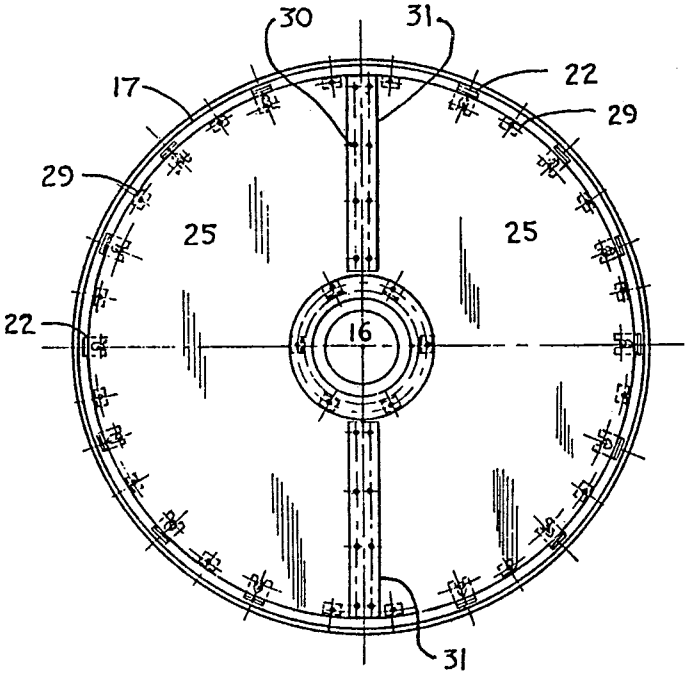
FIG. 4

HEATED CAN ROLLS OF HIGH THERMAL EFFICIENCY

This application is a continuation of application Ser. No. 942,942, filed Sept. 18, 1978, now U.S. Pat. No. 4,348,819.

BACKGROUND OF THE INVENTION

NATURE OF THE INVENTION

This invention is an improvement in internally steam heated can rolls in a papermaking machine. The invention involves means for reducing heat losses in all forms from the heads, or end enclosure, from the can roll to provide a marked increase in thermal efficiency. The invention is particularly adaptable for modification of existing papermaking machines as all parts can be affixed to the roll by attachment to existing head Lolts that bolt the heads onto the cyclindrical shell of the roll. Thus, a minimum of downtime and other expense is expended in order to utilize the invention with respect to existing machines.

The paper industry is one of the largest industries with respect to consumption of energy in the world. A sizable portion of this energy is wasted from the heads of the drying sections of the papermaking equipment.

The mechanism of heat losses from the outside surface of the heads of the associated can rolls is a combination of radiation and various forms of convection. Radiative losses due to the surface emission of heat are about 10% of the total losses. Convection losses are best considered as comprising three components. The primary mode is the convection as a result of external air draft provided to aid in driving out the moisture from a web being dried. A secondary contribution to convection comes from the relative air movement generated by the rotation of the dryer roll head itself, which at moderate operating speeds has a similar magnitude of heat loss as from the radiative losses above. The final component is the natural free convection resulting from the temperature differential between the external surface of the head and the ambient air.

Typically, with a 60 inch diameter can roll operating at 1200 feet per minute using 300° F. steam, the radiative loss, natural convection loss, and convection due to rotation are of similar orders of magnitude and generally total less than about 30% of the total head heat loss. Heat loss from the shaft itself is generally less than about 7%. The balance of the heat loss, which is generally greater than two-thirds of the total loss from the heads, is from the forced convection due to air draft.

As is seen from FIG. 7, herein, the practice of this invention at today's energy cost, can commonly result in annual energy savings of up to $14,000 per head, depending upon precise operating conditions. One papermaking machine may have more than twenty such can rolls.

DESCRIPTION OF THE PRIOR ART

Various types of conventional drier drums, or can rolls are illustrated in the following U.S. Pat. Nos.: 3,118,743 that issued to Malmstrom, et al. Jan. 21, 1964; 3,116,985 that issued to Kraus Jan. 7, 1964; 3,217,426 that issued to Barnsheidt et al. Nov. 16, 1965; 3,248,803 to Kirkorian that issued May 3, 1966; 3,911,595 that issued to Lande Oct. 14, 1975; 2,374,745 that issued to Grimm May 1, 1945; 2,779,104 to Sims on Jan. 29, 1957; and 2,817,908 that issued to Hornbostel Dec. 31, 1957.

U.S. Pat. No. 1,076,330 that issued to Thompson Oct. 21, 1913 discloses radiative insulation means comprising the formation of a dead air space exterior of the head which is stated to be an improvement over the earlier method of covering the head with a layer of magnesia that could then be covered with a metal sheet. U.S. Pat. No. 1,640,855 that issued to Shlick Aug. 30, 1927 discloses means for covering head members with insulating material to reduce radiative losses and protect workers from the danger of becoming entangled with protruding bolts from the heads.

SUMMARY OF THE INVENTION

This invention, for which I desire to secure Letters Patent, is defined as being in a papermaking machine having multiple cylindrical can rolls for drying a continuous sheet of papers fibers, said can rolls:

A. being comprised of a cylindrical shell of a finite wall thickness having ends that are enclosed with head members that are bolted with bolt means into the wall thickness circumferentially around the shell to provide a fluid tight seal, and shaft means extending from each head member in axial alignment with said cylindrical shell to provide a rotatable can roll;

B. having associated internal heating means for heating the rolls with high pressure steam; the improvement which comprises providing head member insulating means operatively associated with at least one of the head members of A, said insulating means comprising;

(1) outer rim means having an inboard edge and an outboard edge of a diameter not exceeding the diameter of the head member, said outer rim means having a substantial width and further having heat insulating material adjacent to an interior portion of the width;

(2) clip means affixed to the bolt means of A and further affixed to an inboard edge of the outer rim of (1) to hold the inboard edge of the outer rim in a sealing relationship with the head member;

(3) segmental face heat insulating means affixed to the outboard edge of the outer rim, said segmental face heat insulating means having heat insulating material adjacent to its inboard portion and being formed of at least two semicircular segments adapted to allow the shaft means to pass therethrough, said segments being held together in a sealing relationship with splice plate means; said outer rim means of (1) and its insulating material in conjunction with the segmental face heat insulating means of (3) and its insulating material defining an air space between the insulating materials of (1) and (3) and the associated head member;

to provide a heated can roll of greatly improved thermal efficiency by reducing all forms of heat loss from the head member, including heat loss through natural convection, convection due to rotation, forced convection due to air draft, and radiation.

It is preferred that the segmental face insulating means of (3) includes a first set of two semicircular metal sheets adapted and disposed to substantially enclose the outboard end of the outer rim of (1) and allow the shaft means to pass therethrough, while maintaining a sealed relationship between the shaft means and the segmental means and between the segmental means and the outboard edge of the outer rim, said sheets being rigidly attached to each other with splice plate means.

It is more preferable to have a second set of semicircular metal sheets parallel and inboard of the first set to provide a cavity for receiving the insulating material. It is preferred that the segmental face heat insulating means be rigidly and detachably affixed to the outer rim to facilitate easy removal for servicing of the can roll and its head.

It is also preferred to have an inner rim to provide a space between the rims for receiving the rim insulating material.

BRIEF DESCRIPTION OF THE DRAWINGS

FIG. 4 is an end view of the modified can roll of FIG. 3, the shaft means being 16.

FIG. 5 is a broken away cross section of the modified head of FIG. 3.

FIG. 6 is a front view of an angle clip 22 useful for attaching the modifications of this invention to existing head bolts 19.

DETAILED DESCRIPTION OF THE INVENTION

Figure 1:
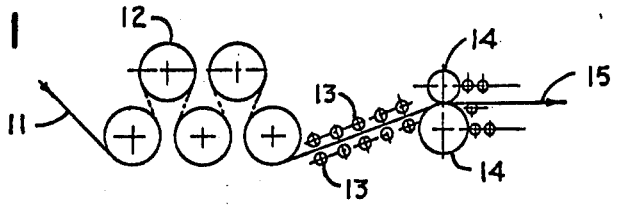
FIG. 1 is a diagrammatic schematic illustration of a papermaking machine dryer portion, showing an end view of heated can rolls 12.
Figure 2:
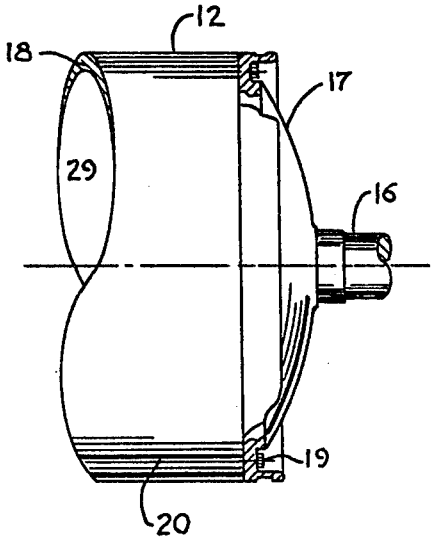
FIG. 2 is a side elevational view of an end portion of a conventional can roll showing its associated head member 17, partially broken away to show the interior of shell 29 and head bolt 19.
Figure 3:
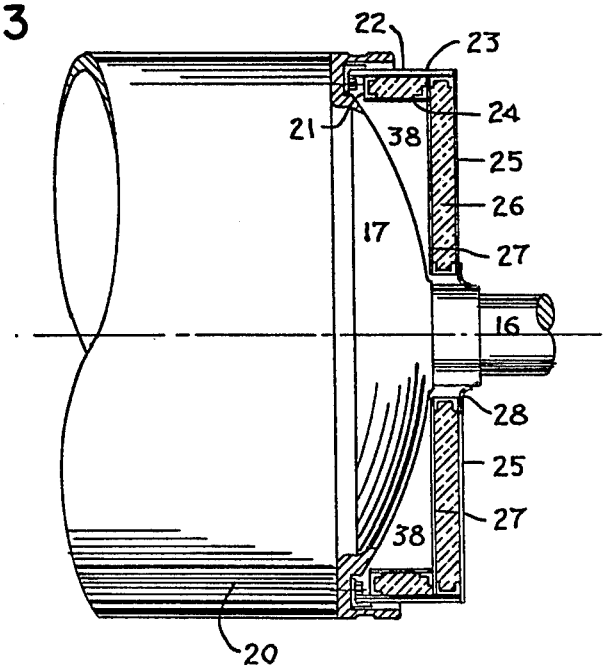
FIG. 3 is a similar view of the conventional can roll of FIG. 2 after having been modified with the addition of the apparatus of this invention that is shown in cross section on the right hand side of head 17.

The invention is best described with reference to the figures of the drawings, wherein the same reference characters refer to the same parts throughout the figures.

A wet web to be dried 11, passes around can rolls 12, through guide or nip rolls 13, and out through discharge rolls 14 as a dried product in the form of a coherent web of sheet 15.

The shell 18 of the can roll has internal cavity 29 and exterior drying surface 20. Head 17 encloses the end of the cavity 29 and is bolted into the shell wall 18 with head bolts 19 that are spaced circumferentially around shell 18. Shaft means 16 is associated with head 17 to provide rotational means.

The head modifications to provide the improved highly thermal efficient head of this invention are illustrated in FIGS. 3, 4, 5, and 6. Angle clips 22 are affixed to head bolts 19 to provide means for retaining outer rim 23 in a sealing relationship with head 17. Head bolts 19 are received within space 33 of the angle clips 22 and portion 34 of the clip engages the outer rim 23 which is secured thereto by welding or other suitable fastening means. Portion 32 of the clip engages head 17.

Outer rim 23 has insulating material 26 of a low heat conductivity, such as ceramic fibers, held adjacent to its interior width portion.

The outboard end of outer rim 23 is enclosed with a number of parts comprising segmental heat insulating means comprising: face plate 25 having two semicircular sections to enclose the outer rim 23 and receive shaft means 16 passing therethrough, and being held together with splice plate means 31 detachably affixed with bolts and associated "rivnuts" or other suitable means 30 to face plate 25. Face Plate 25 is rigidly secured to outer rim 23 with clips 29 spaced around the rim 23. Sealing material 28, such as urethane rubber is affixed to face plate 25 to seal the shaft periphery and face plate 25.

Insulating material 26 is affixed adjacent to the inboard side of face plate 25, providing a dead air space 38 between the face plate 25 and its insulation 26, and the exterior of head 17.

Inner rim 24 is spaced from and rigidly attached to outer rim 23 with channel spacers 21 and the associated rivets or other suitable fastening means.

A second set of semicircular sheets 27 held together with splice plate means 31 and bolts 30 is arranged inboard of face plate 25 to provide a cavity for holding insulating material 26. The plates are spaced from each other with channel clips 29 and 21 and associated rivet or bolt means 29 and 37. Angle clip 35 and associated fastening means affixes inner rim 24 to back plate 37 to provide a rigid structure.

It is preferred that screw means such as a bolt and an associated "rivnut" be used at appropriate locations as the fastening means to facilitate removal of the face plate and back plate to provide easy access to the head for routine maintenance of the can roll.

Outer rim 23 typically has a width of about 7 inches and the inner rim about 5.5 inches, but these can vary to accommodate specific head designs. The thickness of the insulating material is typically about 1.5 inches.

The splice plates and rim support are preferably of stainless steel and the remainder of the parts of aluminum.

The energy savings resulting from the practice of this invention are evaluated on an internally steam heated 12 foot diameter can roll of a papermaking machine under various operating conditions. The insulation thickness is about 1.25 inches and comprised of a ceramic fiber blanket having a specific heat at 1800° F. mean of 0.255 Btu/lb./°F.

Figure 7:
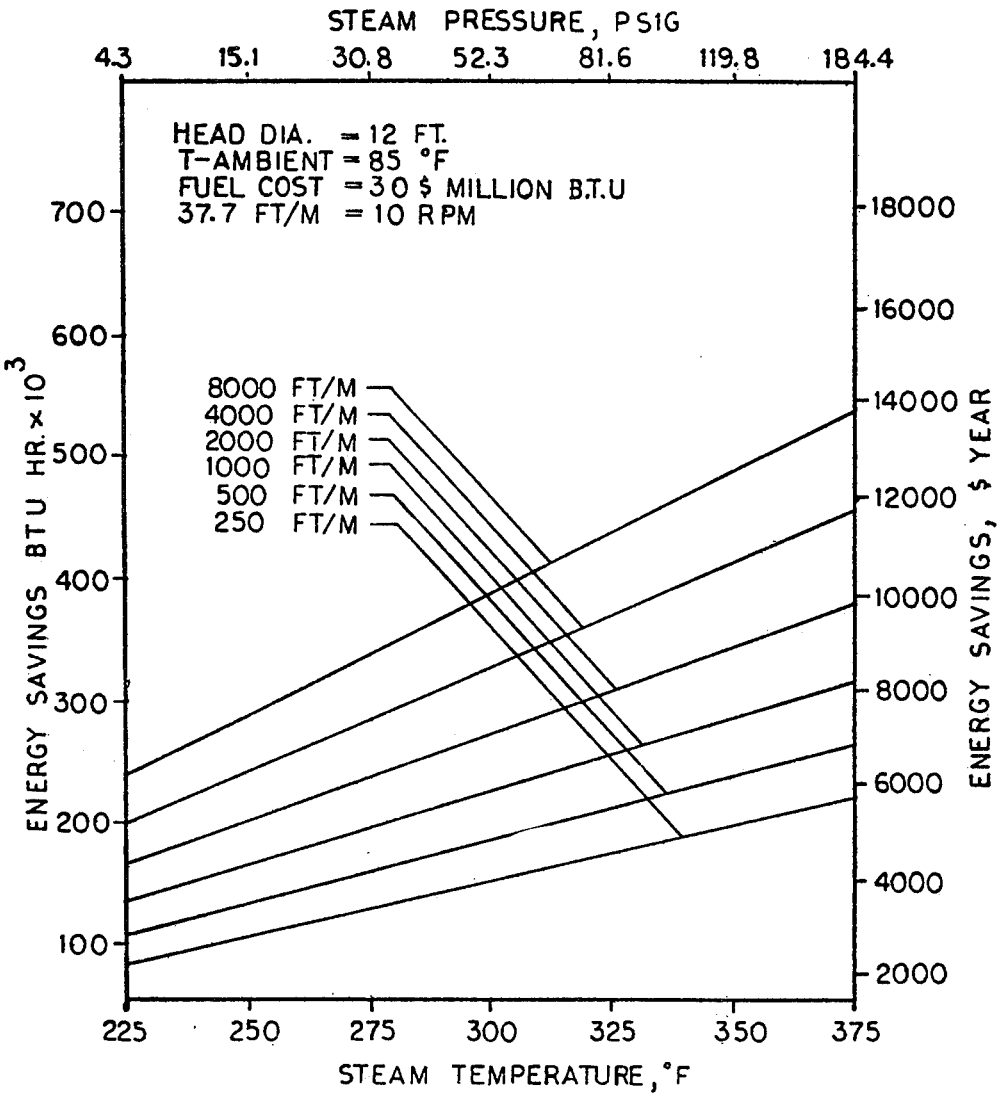
FIG. 7 is a graphical representation of a specific embodiment of this invention showing energy savings at various operating conditions for a 12 foot diameter can roll.

The operating conditions and the resulting savings are set forth in FIG. 7.

A typical desirable insulating material is a ceramic fiber blanket sold by Babcock and Wilcox under the registered trademark "Kaowool."

What is claimed is:

1. In combination, a cylindrical can roll for drying a continuous fibrous sheet, said can roll being mounted for rotation about its longitudinal axis and having head members attached to the cylindrical body portion thereof by means of a plurality of circumferentially spaced bolts, the heads of which bolts project axially from said head members, thermal insulation means for at least one of said head members, said thermal insulation means comprising a substantially circular panel of thermal insulating material mounted axially of said head member, stud means mechanically affixed to at least some of the heads of said bolts and extending axially of said can roll and engaging in fixed relation said thermal insulating material at circumferential points corresponding to said bolt heads.

2. The assembly of claim 1 in which said stud means mechanically affixed to said bolt heads comprises a stud having a first portion which engages a said bolt head and a second portion which extends axially of said can roll and engages said thermal insulation means.

3. The assembly of claim 2 in which the first portion of said stud comprises spaced prongs which underlie a bolt head whereby said stud is maintained in fixed relation with respect to said can roll by friction engagement with said bolt head and said can roll head member.

4. The assembly of claim 1 in which said circular panel of heat insulating material comprises two semicircular segments which abut along their straight edges.

5. The assembly of claim 1 in which there is interposed between said circular panel of thermal insulating material and a head member of said can roll an annular band of thermal insulating material having an outside diameter no greater than the diameter of said can roll, said annular band being held in fixed relation with respect to said can roll head member by means of said studs.

6. In combination, a thermal insulation material end panel assembly for mounting on an axial end face of a heatable dryer cylinder, said dryer cylinder being capable of drying a web passing over the peripheral surface thereof, said dryer cylinder bearing a plurality of bolts having bolts heads projecting axially from and end face thereof at spaced circumferential positions and a plurality of stud means fixed to the side of said thermal insulation material end panel at circumferential positions corresponding to said bolt heads and projecting therefrom, and said stud means being mechanically clamped to said bolt heads for removably locking said panel to the end of said dryer cylinder.

7. In a papermaking machine having at least one heatable cylindrical can roll for drying a continuous fibrous sheet, said can roll being mounted for rotation about its longitudinal axis and comprising a cylindrical shell having the ends thereof enclosed by head members secured to said shell by a plurality of bolts located in spaced circumferential positions about said head members with the heads of said bolts projecting outward axially of said head ends, the improvement which comprises thermal insulating means for at least one of said head members, said insulating means comprising:

(1) annular thermal insulating means adjacent to and extending axially of said head member and having a diameter not exceeding the diameter of said head member and thermal insulating material extending over a surface thereof;

(2) circular thermal insulating means having a diameter such that the outer peripheral edge thereof engages said annular thermal insulating means, said circular thermal insulating means being formed of at least two arcuate segments having thermal insulating material extending over a surface thereof;

(3) means mechanically affixed to a plurality of said bolt heads and extending axially of said can roll and engaging said annular thermal insulating means and said circular insulating means to maintain said insulating means in fixed relation with respect to each other and to said head member;

said annular and said circular thermal insulating means defining a substantially closed air space exterior of said head member to reduce heat loss from said head member.

8. The assembly as claimed in claim 7 in which said annular thermal insulating means comprises radially spaced annular metal sheets with thermal insulating material therebetween, and said arcuate segments forming said circular thermal insulating means comprise substantially flat axially spaced metal sheets having thermal insulating material therebetween.

9. The assembly according to claim 7 in which said circular insulating means comprises two substantially semicircular segments.

10. The assembly according to claim 7 in which said annular and circular thermal insulating means are held in fixed relation by means of studs having a first portion comprising spaced prongs which underlie a bolt head whereby said stud is maintained in a fixed position with respect to said can roll by friction engagement with said bolt head and said can roll head member, and a second portion which extends axially of said can roll to engage said annular and circular thermal insulating means.

* * * * *